US008403693B2

(12) United States Patent
Uchida

(10) Patent No.: US 8,403,693 B2
(45) Date of Patent: Mar. 26, 2013

(54) CONNECTOR

(75) Inventor: Tomohisa Uchida, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 17 days.

(21) Appl. No.: 13/104,135

(22) Filed: May 10, 2011

(65) Prior Publication Data

US 2011/0287648 A1 Nov. 24, 2011

(30) Foreign Application Priority Data

May 19, 2010 (JP) ..... 2010-115441

(51) Int. Cl.
*H01R 13/52* (2006.01)

(52) U.S. Cl. ..... 439/271

(58) Field of Classification Search ..... 439/271, 439/587, 471; 174/628, 23 R
See application file for complete search history.

(56) References Cited

U.S. PATENT DOCUMENTS

| | | | | |
|---|---|---|---|---|
| 6,911,600 | B2 * | 6/2005 | Kiyota et al. | 174/668 |
| 6,982,379 | B2 * | 1/2006 | Saka et al. | 174/50 |
| 7,476,121 | B2 * | 1/2009 | Tsuji | 439/471 |
| 7,639,476 | B2 * | 12/2009 | Sasaki et al. | 361/641 |
| 7,785,128 | B2 * | 8/2010 | Ito et al. | 439/352 |
| 7,950,962 | B2 * | 5/2011 | Mase et al. | 439/587 |
| 2005/0239332 | A1 * | 10/2005 | Maegawa et al. | 439/628 |
| 2007/0141904 | A1 * | 6/2007 | Hayashi | 439/587 |
| 2008/0000672 | A1 * | 1/2008 | Yamamoto et al. | 174/23 R |
| 2008/0055821 | A1 | 3/2008 | Sasaki et al. | |
| 2008/0280467 | A1 | 11/2008 | Tsuji | |
| 2009/0149052 | A1 | 6/2009 | Ito et al. | |
| 2009/0191749 | A1 | 7/2009 | Mase et al. | |
| 2011/0214897 | A1 * | 9/2011 | Yoshida | 174/50.51 |
| 2011/0287648 | A1 * | 11/2011 | Uchida | 439/271 |

FOREIGN PATENT DOCUMENTS

| | | |
|---|---|---|
| FR | 2844106 | 3/2004 |

* cited by examiner

*Primary Examiner* — Alexander Gilman
(74) *Attorney, Agent, or Firm* — Gerald E. Hespos; Michael J. Porco; Matthew T. Hespos

(57) ABSTRACT

A connector housing (10) is formed with a seal tower (18) projecting backward from the rear surface of the connector housing and adapted to accommodate seals (20). A peripheral wall (21) surrounds the seal tower (18) and projects back from the rear surface of the connector housing (10). A rearwardly open groove-shaped annular recess (22) is formed between the seal tower (18) and the peripheral wall (21) and has a bottom surface (23) that defines the rear surface of the connector housing. The bottom surface (23) of the recess (22) is continuous over the entire circumference, and the peripheral wall (21) is formed with water drains (24) that cause the inside of the recess and an outer peripheral side of the peripheral wall to communicate.

16 Claims, 9 Drawing Sheets

CONNECTOR

BACKGROUND OF THE INVENTION

1. Field of the Invention

The invention relates to a connector.

2. Description of the Related Art

U.S. Patent Application Publication No. 2009/0191749 discloses a waterproof connector including a housing internally formed with cavities, terminal fittings to be inserted into the cavities from behind, wires connected to rear end portions of the terminal fittings and seals through which wires are passed. A seal tower projects back from the rear surface of the housing to accommodate the seals, and a peripheral wall surrounds the seal tower over the entire periphery and projects back from the rear surface of the housing. A rearwardly open annular recess is formed between the outer periphery of the seal tower and the inner periphery of the peripheral wall and has a bottom surface at the rear surface of the housing.

Water may pool in the recess of the above-described connector when the housing is placed with the rear surface facing up. If this happens, the water pooled in the recess may flow down to a mating connector when the housing is inclined to be connected to the mating connector.

The invention was developed in view of the above situation and an object thereof is to prevent water from remaining in a recess in a connector in which the recess is formed on the rear surface of a connector housing.

SUMMARY OF THE INVENTION

The invention relates to a connector with a housing, at least one terminal fitting to be inserted into the housing and a seal through which at least one wire to be connected to the terminal fitting is to be passed. A seal tower projects from the housing and is adapted to accommodate the seal. A peripheral wall projects from the housing in substantially the same direction as the seal tower and surrounds the seal tower. An outwardly open recess is formed between the outer periphery of the seal tower and the inner periphery of the peripheral wall. The peripheral wall is formed with at least one water drain that provides communication between the inside of the recess and an outer peripheral side of the peripheral wall.

The recess preferably is an annular groove. The bottom surface of the recess preferably forms the rear surface of the housing and the recess open backward.

The bottom surface of the recess preferably is substantially continuous over the entire periphery.

If water enters the recess with the rear surface of the housing faced up, this water runs down toward the water drain along the bottom surface of the recess and is discharged to the outside of the recess from the water drain. Since the bottom surface of the recess is continuous over the entire circumference, the water having entered the recess is discharged reliably.

The bottom surface of the recess preferably is substantially continuous and flush over the entire circumference. Thus, water in the recess reliably reaches the water drain to be discharged.

The water drain preferably is formed by cutting off the rear end edge of the peripheral wall. Thus, the housing including the peripheral wall can be formed by a mold that is opened in forward and backward directions. Accordingly, a mold cost can be reduced by simplifying a mold structure.

At least one reinforcement preferably projects from the inner peripheral surface of the peripheral wall. The at least one reinforcement preferably is connected to the outer peripheral surface of the seal tower.

The front end edge of the at least one reinforcement preferably at least partly faces and/or is spaced from the bottom surface.

The connection of the peripheral wall to the seal tower via the reinforcement prevents the peripheral wall from deforming to be inclined toward an inner peripheral side or an outer peripheral side. Further, the spacing of the front end edge of the reinforcement from the bottom surface of the recess ensures that the flow of water in the recess will not be blocked by the reinforcement and water drainage is not hindered.

At least one space is between the bottom surface and the front end edge of the reinforcement in the recess and serves as at least one water passage hole that allows the passage of water flowing along the bottom surface.

The water drain preferably is formed into a window hole by cutting the peripheral wall in an area of projection of an opening of the water passage hole.

If the water drain was formed by cutting off the rear end edge of the peripheral wall, strength of a part of the peripheral wall near the water drain may be reduced since a rear end edge of the peripheral wall is divided by the cut-off part, i.e. the water drainage portion. However, the water drain is in the form of a window hole and the rear end edge portion of the peripheral wall is continuous without being divided even at the part near the water drain. Hence, the strength of the part of the peripheral wall near the water drainage is not reduced.

At least one support project at an angle, preferably substantially at a right angle from the inner peripheral surface and/or substantially continuous with the bottom surface are formed on the peripheral wall.

The support preferably is substantially a plate with a substantially constant thickness or shaped so that the thickness becomes larger toward the peripheral wall.

The bottom surface preferably is stepped or inclined to be successively lowered from a side of the seal tower to the water drain with the bottom surface faced up.

These and other objects, features and advantages of the invention will become more apparent upon reading the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
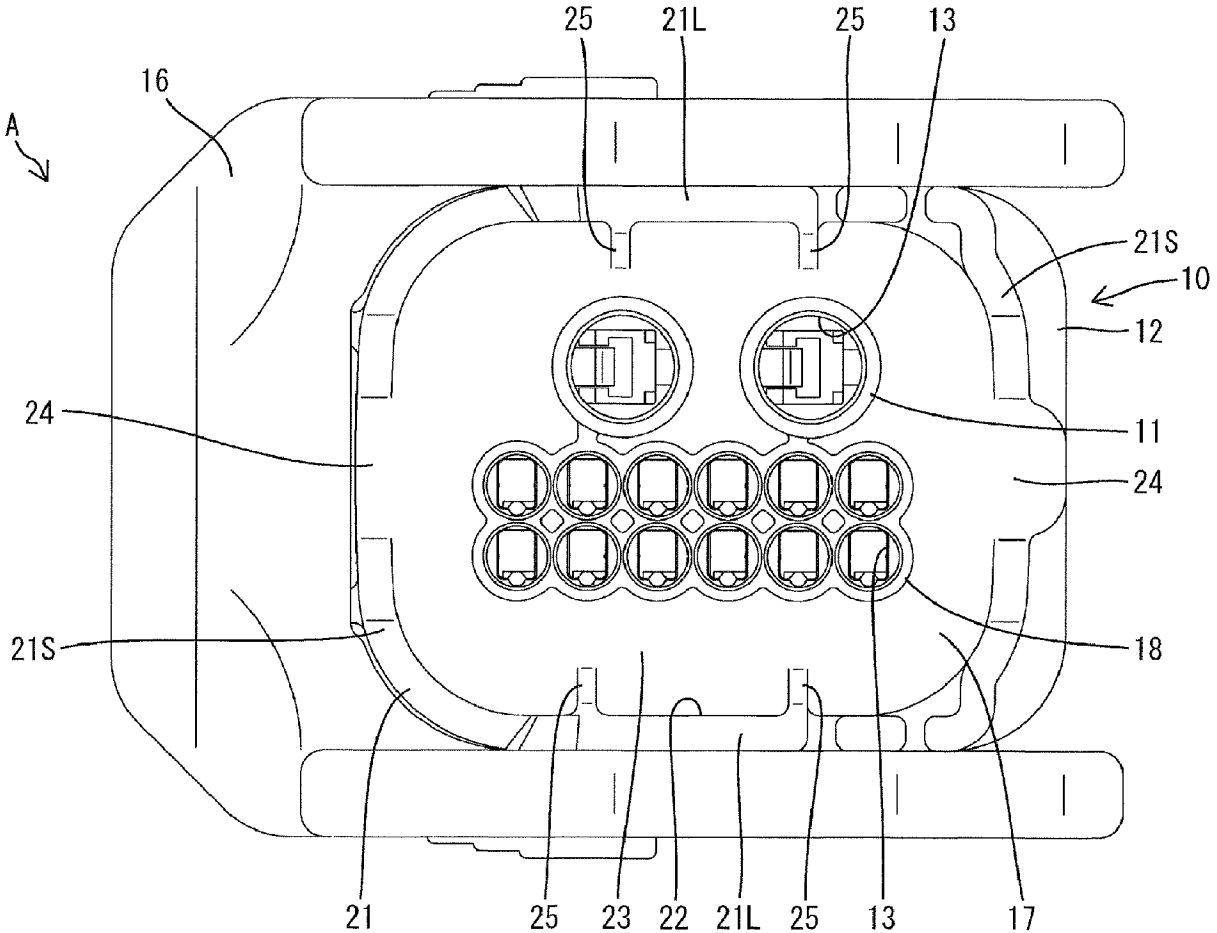
FIG. 1 is a plan view showing a state where a lever is displaced to a connection position in a first embodiment.
Figure 2:
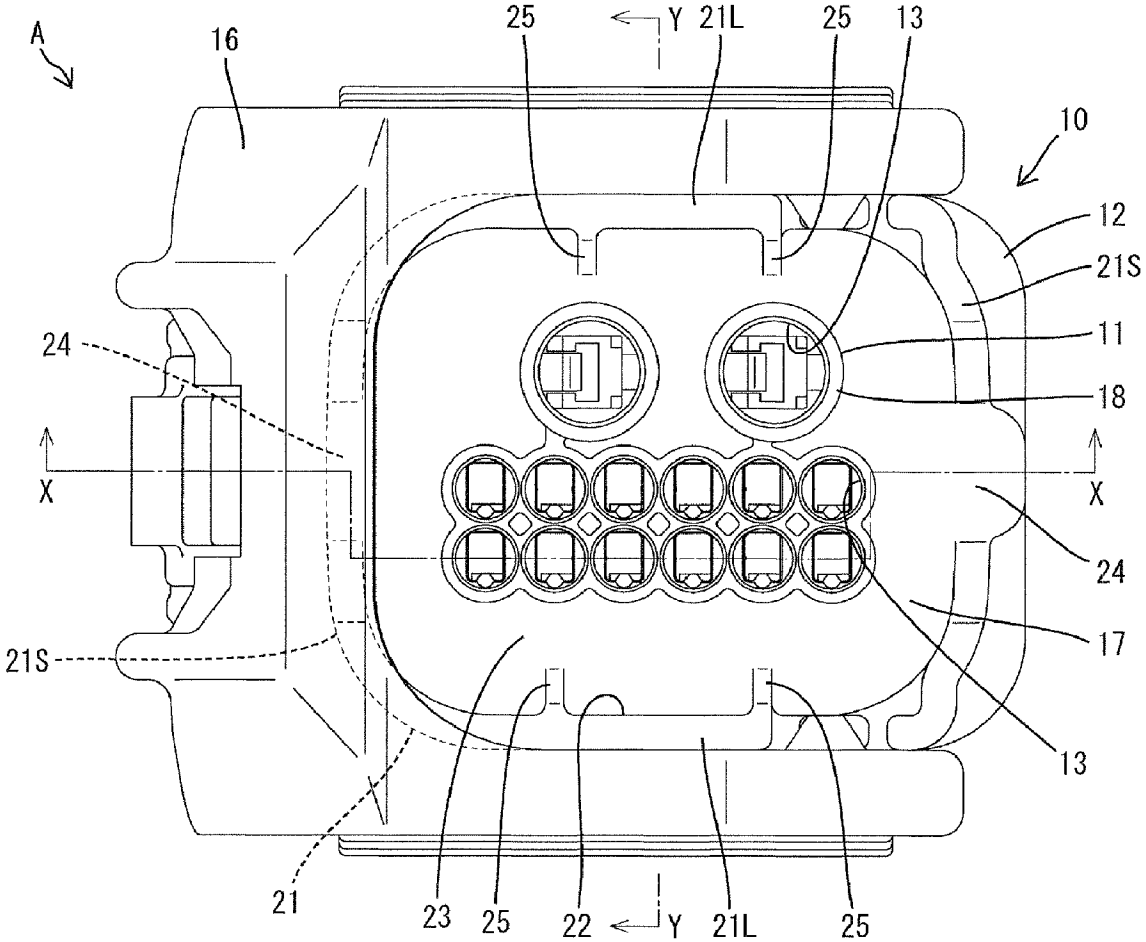
FIG. 2 is a rear view showing the lever displaced to an initial position.
Figure 3:
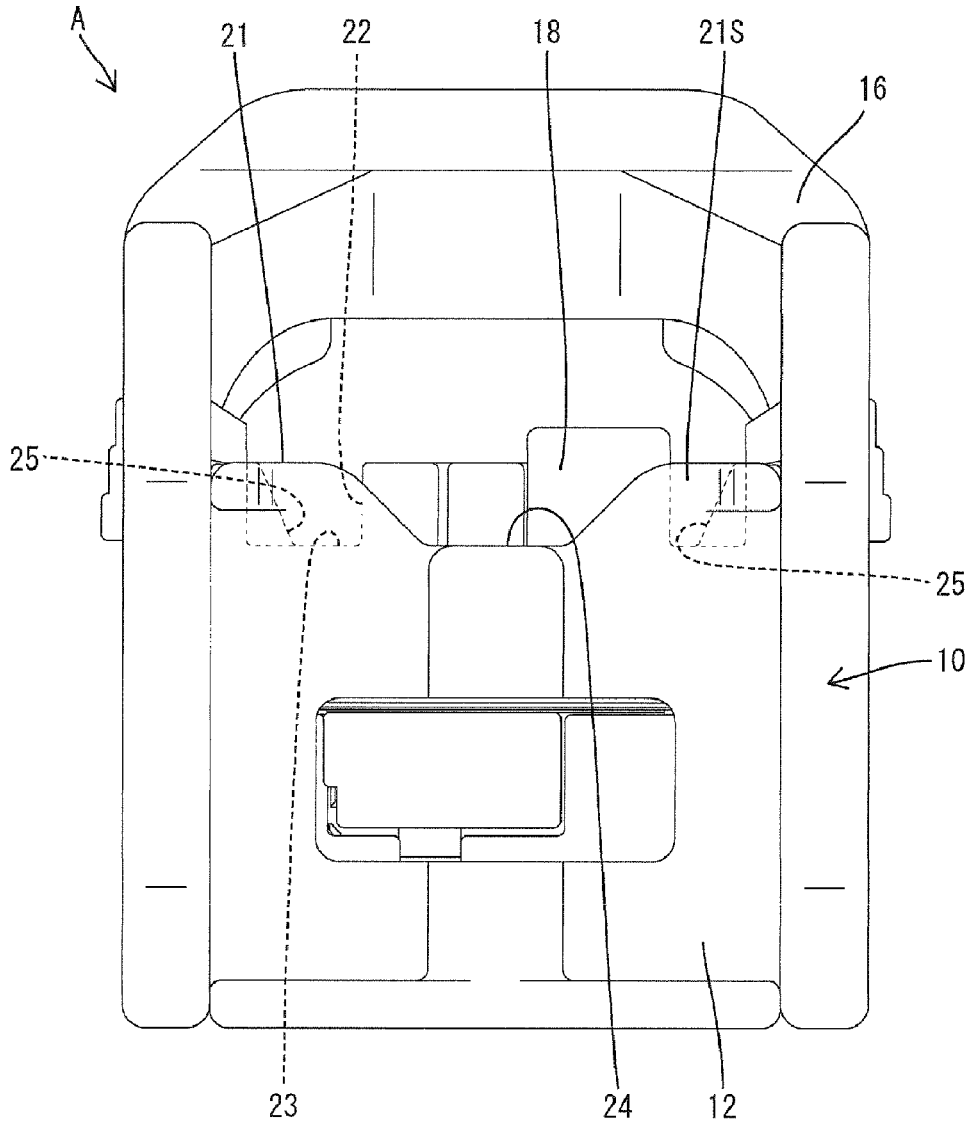
FIG. 3 is a side view showing the lever displaced to the initial position.

A first embodiment of the invention is described with reference to FIGS. 1 to 6. A connector A of this embodiment has a fluid- or waterproof function and includes a housing 10 made e.g. of synthetic resin, terminal fittings 14 to be inserted into the housing 10, one or more waterproof seals 20 and a lever 16.

The housing 10 is formed integrally or unitarily to include a substantially block-shaped terminal accommodating portion 11 and a tubular fitting 12 at least partly surrounding the terminal accommodating portion 11. The tubular fitting 12 is connected to the outer periphery of the terminal accommodating portion 11 at its rear end. Cavities 13 penetrate through the terminal accommodating portion 11 in forward and backward directions (vertical direction in FIGS. 4 and 6), and the terminal fittings 14 are inserted into the cavities 13 from the rear end of the housing 10. Wires 15 are connected conductively to rear ends of the respective terminal fittings 14, and are drawn out backward from the rear end surface of the housing 10 with the terminal fittings 14 inserted in the cavities 13.

The connector A and a mating connector B are connected by rotating a lever 16 mounted on the connector A. The lever 16 is rotatable between an initial position shown in FIGS. 2 to 5 and a connection position shown in FIGS. 1 and 6. The two connectors A, B can be fit lightly together with the lever 16 displaced to the initial position. Thus, cam followers (not shown) of the mating connector B enter cam grooves (not shown) of the lever 16. The lever 16 then is rotated to the connection position and displays a force multiplying cam action.

The rear end of the tubular fitting 12 and the outer periphery of the rear end portion of the terminal accommodating portion 11 are connected at the rear end of the housing 10 by at least one support 17 substantially continuously over the entire periphery. A seal tower 18 projects back from the support 17 at the rear end of the terminal accommodating portion 11. The seal tower 18 is a collection of substantially cylindrical tubes formed by extending the cavities 13 backward, and the outer periphery surface of the seal tower 18 is formed by arcuate surfaces. Seals 20 are fit respectively in the tubes of the seal tower 18. The wires 15 connected to the respective terminal fittings 14 are passed through the seals 20 in a fluid- or liquid-tight manner so that the outer peripheries of the seals 20 are held in close contact with the inner peripheral surfaces of the tubes in a fluid- or liquid-tight manner. Thus, clearances between the outer peripheries of the wires 15 and the inner peripheries of the cylindrical portions (cavities 13) are sealed by the seals 20 to prevent entry of fluid, such as water entrance into the cavities 13 from behind.

The rear surface of the support 17 forms part of the rear surface of the housing 10 and is a substantially flat surface substantially perpendicular to an inserting direction of the terminal fittings 14 into the cavities 13. A peripheral wall 21 projects back from the outer peripheral edge of the support 17 and surrounds the seal tower 18. The peripheral wall 21 is substantially rectangular when viewed from behind with four substantially quarter-circular rounded corners. A rearwardly open groove-shaped recess 22 is formed between the inner periphery of the peripheral wall 21 and the outer periphery of the seal tower 18 and has a bottom surface 23 that is the rear surface of the support 17. The recess 22 is continuously annular over the entire circumference. The bottom surface 23 of the recess 22 is substantially is continuous and flush over the entire circumference.

Figure 4:
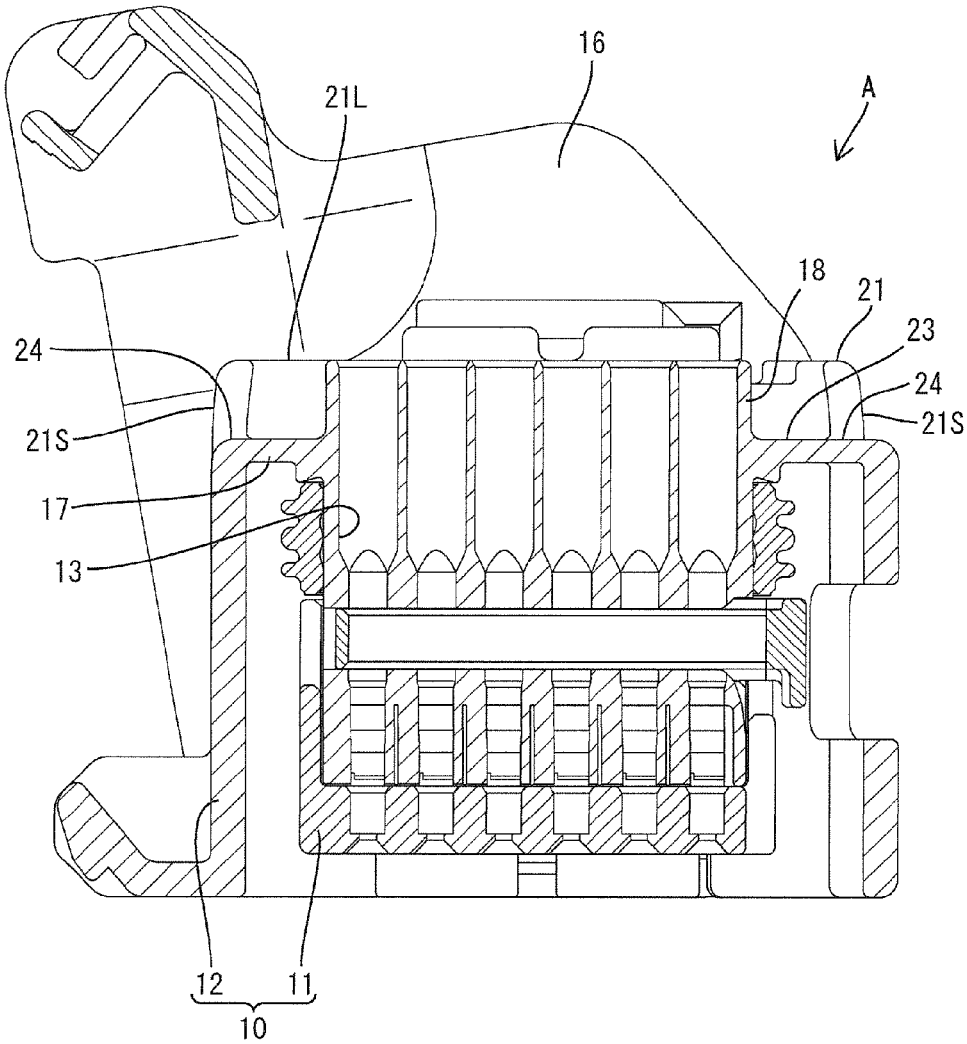
FIG. 4 is a section along X-X of FIG. 2.

The peripheral wall 21 includes two longer side walls 21L and two shorter side walls 21S, and at least one cut is made in the rear end edge of the peripheral wall 21 in each of the shorter side walls 21S to form water drains 24. The water drains 24 provide communication between the internal space of the recess 22 and the external space of the peripheral wall 21. Parts of the edges of the water drains 24 near the bottom surface 23 are substantially continuous and flush with the bottom surface 23. As shown in FIG. 4, the edges of the water drains 24 are substantially in the form of quarter-circular arcs extending from the bottom surface 23 to the outer peripheral surface of the tubular fitting 12. The water drains 24 of two shorter side walls 21S are arranged at the substantially opposite sides of the seal tower 18.

Figure 5:
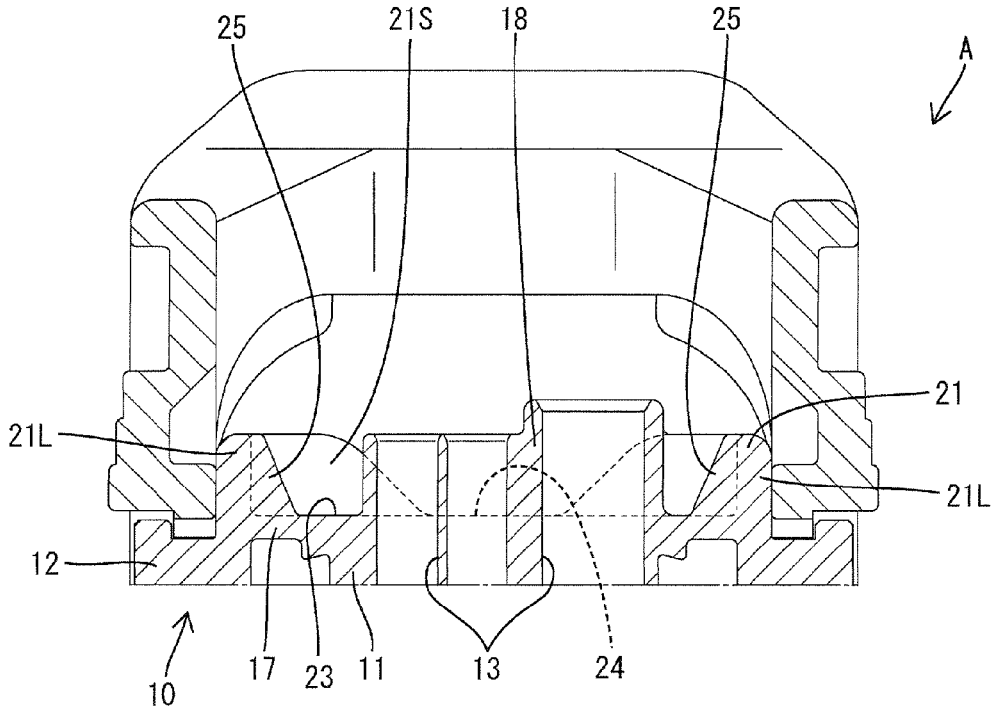
FIG. 5 is a section along Y-Y of FIG. 2.
Figure 6:
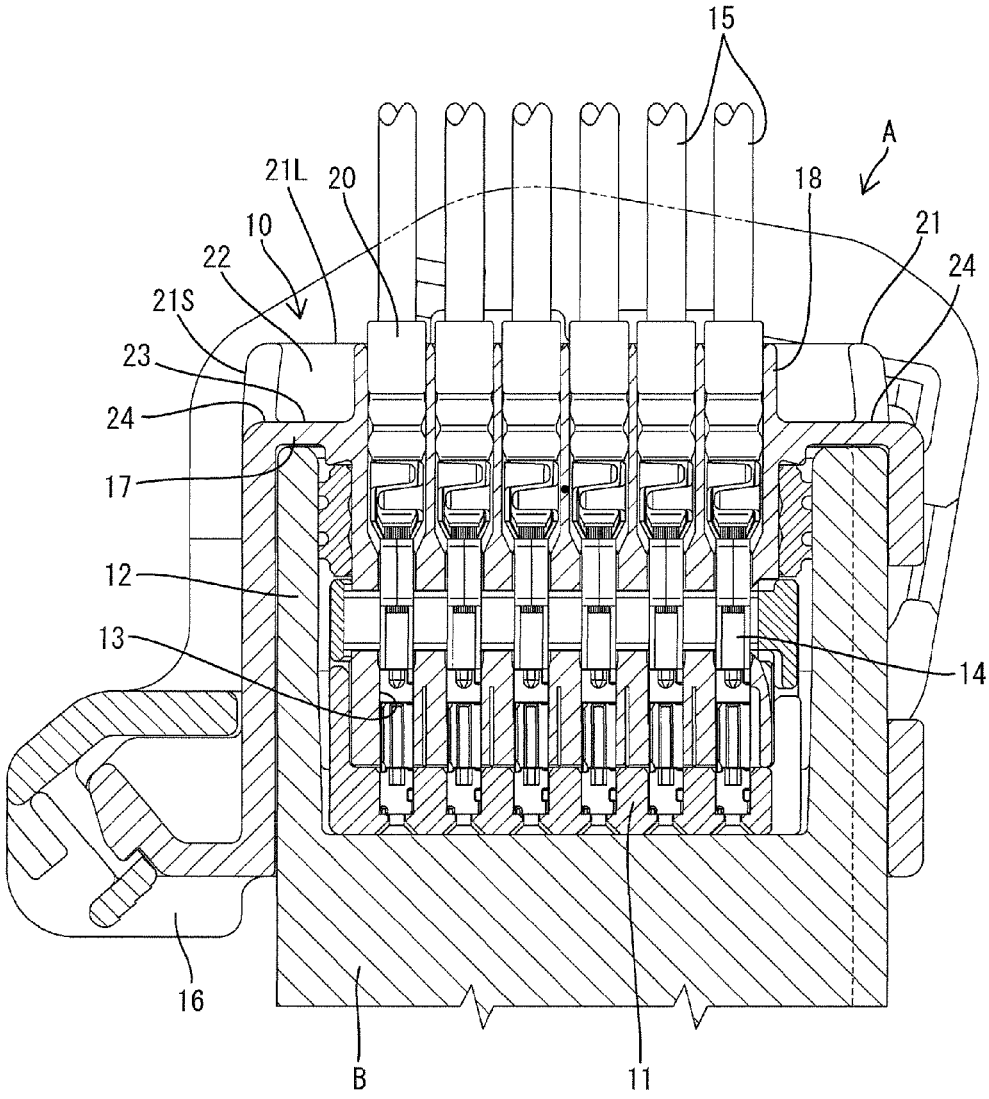
FIG. 6 is a section showing a connected state to a mating connector.

Two substantially plate-like supports 25 project at substantially right angles from the inner peripheral surface of each of the longer side walls 21L. The supports 25 are substantially continuous with the bottom surface 23 and are spaced apart in a longitudinal direction of the longer side wall 21L. Each support 25 has a constant thickness over its entirety. Further, as shown in FIG. 5, the shape of the support 25 when viewed in the longitudinal direction of the longer side wall 21L is a non-isosceles trapezoid approximate to a right triangle. The formation ranges of the supports 25 on the bottom surface 23 in a direction perpendicular to the longer side walls 21L are parts of the bottom surface 23 close to the peripheral wall 21. Accordingly, the lateral edges of the supports 25 are substantially facing and spaced from the outer surface of the seal tower 18. Further, the support 25 of one longer side wall 21L and that of the other side wall 21L are arranged at the substantially opposite sides of the seal tower 18.

The two connectors A, B may be connected while the mating connector B is oriented face up. During this connection process the connector A will be brought to the mating connector B from above with the front surface faced down. Accordingly, the rear surface of the housing 10 may faced up. Water deposited on the rear surface of the housing 10 while the connector A is oriented this way will enter the recess 22. Water in the recess 22 may leak out and fall to the mating connector B if the connector A inclines during the connection process.

However, the peripheral wall 21 that forms the outer peripheral wall of the recess 22 is formed with the water drains 24 that cause the inside of the recess 22 to communicate with the outside of the recess 22. Thus, even if water deposited on the rear surface of the housing 10 enters the recess 22, this water runs along the bottom surface 23 and is discharged to the outside of the recess 22 from the water drains 24. Therefore, there is no likelihood that the water remains in the recess 22.

The bottom surface 23 of the recess 22 is substantially continuous over the entire circumferences. Thus, water that enters the recess 22 is discharged reliably. In addition, the bottom surface 23 of the recess 22 is substantially continuous and flush over the entire circumference without being stepped or inclined. Thus water in the recess 22 reliably reaches the water drains 24 to be discharged.

The housing 10 is formed using a mold (not shown) that substantially is opened in the same direction as the penetration direction of the cavities 13 (inserting direction of the terminal fittings 14). If the water drains in the form of window holes penetrate the peripheral wall, a slide mold that is opened in a direction crossing the penetration direction of the cavities 13 is necessary separately from the mold that is opened in the penetration direction of the cavities 13. Therefore, a mold structure becomes complicated, leading to a manufacturing cost increase.

On the contrary, the water drains 24 of this embodiment are formed by cutting off the rear end edge of the peripheral wall 21. Thus, the housing 10 including the peripheral wall 21 can be formed by a mold that is opened in the penetration direction (forward and backward directions) of the cavities 13. In this way, a mold cost can be reduced by simplifying the mold structure.

Figure 7:
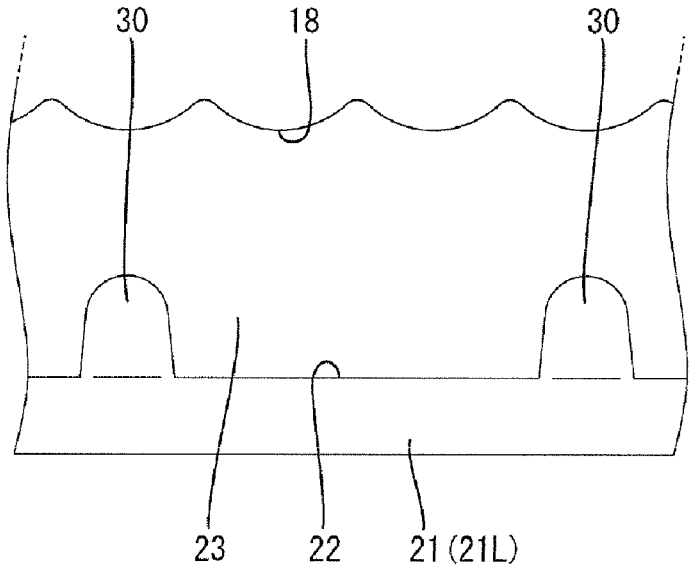
FIG. 7 is a partial enlarged rear view of a second embodiment.

A second embodiment of the invention is described with reference to FIG. 7. In the second embodiment, the shape of supports 30 differs from that of the supports 25 of the first embodiment. Since the other constructions are similar or substantially the same as in the first embodiment, the similar constructions are identified by the same reference numerals and the structures, functions and effects thereof are not described.

The supports 25 of the first embodiment are in the form of plates with a substantially constant thickness. However, the supports 30 of the second embodiment are shaped so that the thicknesses become larger toward the peripheral wall 21 when viewed from behind. Further, the projecting end edges of the supports 25 from the peripheral wall 21 are angular in the first embodiment, whereas the projecting edges of the supports 30 are substantially semicircular when viewed from behind in the second embodiment.

Figure 8:
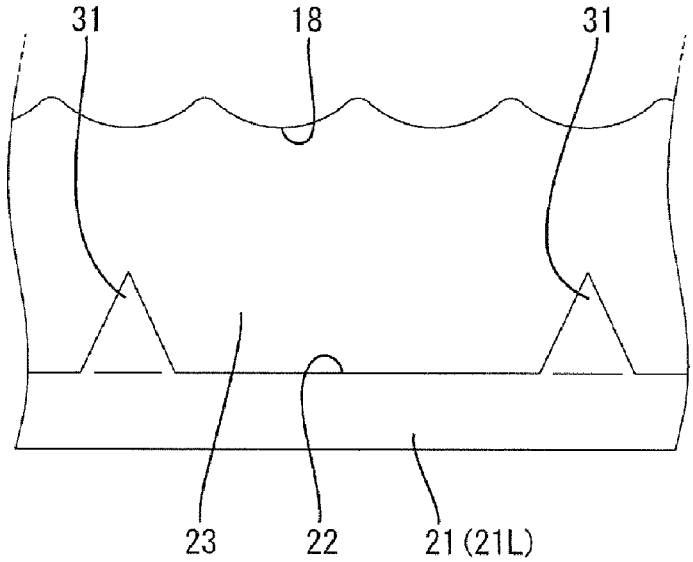
FIG. 8 is a partial enlarged rear view of a third embodiment.

A third embodiment of the invention is described with reference to FIG. 8. In the third embodiment, supports 31 are constructed differently from the supports 25 of the first embodiment. Since the other constructions are similar or substantially the same as in the first embodiment, the similar or substantially same constructions are identified by the same reference numerals and the structures, functions and effects thereof are not described.

The supports 31 of the third embodiment are shaped so that the thicknesses thereof become larger toward the peripheral wall 21 when viewed from behind. Further, projecting end portions of the supports 31 are shaped to be acute-angled and/or pointed when viewed from behind.

Figure 9:
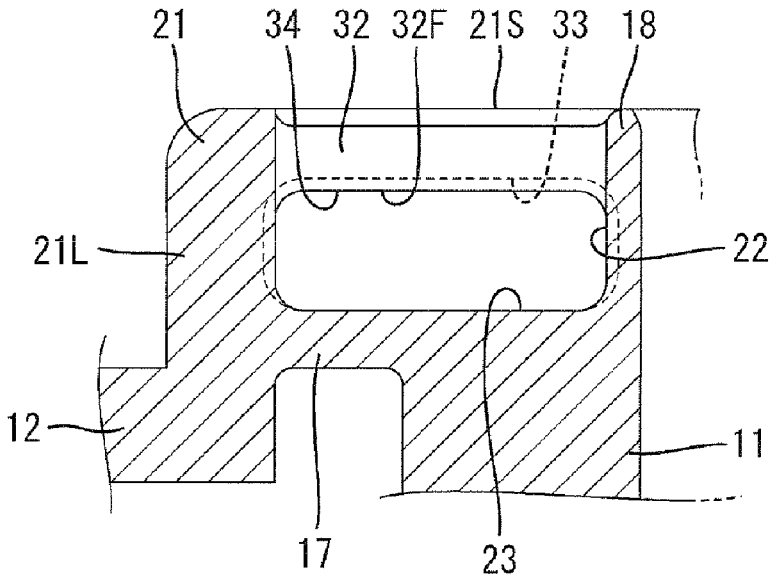
FIG. 9 is a partial enlarged section of a fourth embodiment.

A fourth embodiment of the invention is described with reference to FIG. 9. In the fourth embodiment, reinforcements 32 are provided instead of the supports 25 of the first embodiment and water drains 33 are formed differently from the first embodiment. Since the other constructions are similar or substantially the same as in the first embodiment, the similar or substantially same constructions are identified by the same reference numerals and the structures, functions and effects thereof are not described.

The reinforcement 32 of this fourth embodiment is substantially a plate projecting toward a seal tower 18 substantially in parallel to a bottom surface 23 only from an area of the inner peripheral surface of a peripheral wall 21 spaced back (up in FIG. 9) from the bottom surface 23 and the projecting end thereof is connected to the outer peripheral surface of the seal tower 18. A width of the reinforcement 32 in forward and backward directions (vertical direction in FIG. 9) is substantially constant over the entire length in a projecting distance. Accordingly, a front end edge 32F (lower end edge in FIG. 9) of the reinforcement 32 is facing and spaced from the bottom surface 23 over substantially the entire length in the projecting distance. Parts between the front end edges 32F of the reinforcements 32 and the bottom surface 23 function water passages 34 penetrating substantially in parallel to the inner peripheral surfaces of longer side walls 21L of the peripheral wall 21 connected to the reinforcements 32.

The water drains 33 are window holes formed in the peripheral wall 21, particularly formed in substantially rectangular areas of projection of opening areas of the water passage holes 34 in longitudinal directions of the longer side walls 21L) and/or penetrating through shorter side walls 21S constituting the peripheral wall 21. Although the openings of the water drains 33 are larger than the water passage holes 34 in FIG. 9, the opening areas of the water drains 33 may be substantially equal to those of the water passage holes 34.

Since the longer side walls 21L constituting or forming part of the peripheral wall 21 are connected to the seal tower 18 via the reinforcements 32 in the fourth embodiment, there is no likelihood that the longer side walls 21L are deformed and inclined toward an inner peripheral side or an outer peripheral side. Further, the front end edges 32F of the reinforcements 32 are entirely spaced apart from the bottom surface 23 of the recess 22 and the water passage holes 34 that allow the flow of water are formed between the reinforcements 32 and the bottom surface 23, there is no likelihood that the flow of water in the recess 22 is not blocked by the reinforcements 32 and fluid or liquid or water drainage is not hindered.

In the case of the first embodiment in which the water drains 24 are formed by cutting off the rear end edge of the peripheral wall 21, strengths of parts of the peripheral wall 21 near the water drains 24 may be reduced since a rear end portion of the peripheral wall 21 is divided by the cut-off parts, i.e. the water drains 24. However, the water drains 33 are in the form of window holes and the rear end edge of the peripheral wall 21 is substantially continuous without being divided even at parts near the water drains 33 in the fourth embodiment. Thus, there is no likelihood that the strengths of the parts of the peripheral wall 21 near the water drains 33 are reduced.

If the water drains 33 are in the form of window holes, a mold that is opened in a penetration direction of the water drains 33 (i.e. direction crossing a penetration direction of cavities 13) is necessary. Since penetration areas of the water drains 33 in the peripheral walls 21 are slightly larger than areas of projection of the water passage holes 34 substantially in the same direction as the penetration direction thereof in the fourth embodiment, the water drains 33 and the water passage holes 34 can be formed by a common mold. Thus, a mold cost can be reduced by simplifying a mold structure.

Figure 10:
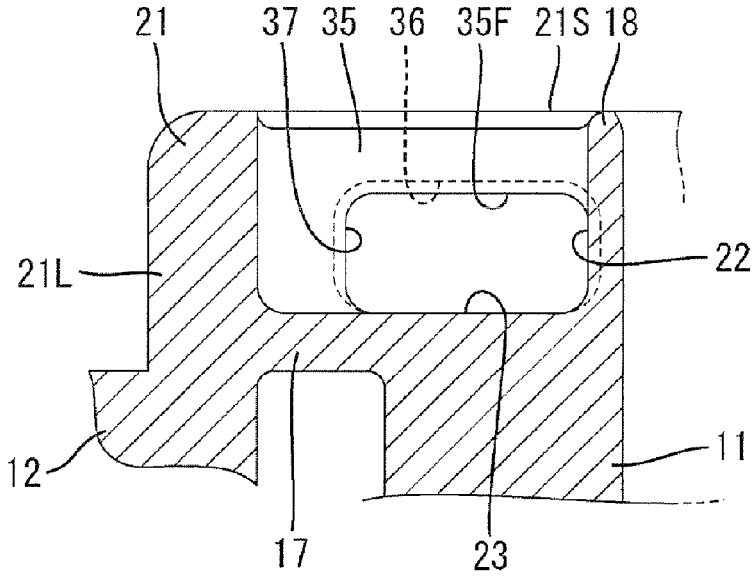
FIG. 10 is a partial enlarged section of a fifth embodiment.

A fifth embodiment of the invention is described with reference to FIG. 10. In the fifth embodiment, reinforcements 35 are provided instead of the supports 25 of the first embodiment. Since the other constructions are similar or substantially the same as in the fourth embodiment, the similar or substantially same constructions are identified by the same reference numerals and are not described.

The widths of the reinforcements 32 of the fourth embodiment in forward and backward directions crossing the projecting directions of the reinforcements 32 are substantially constant in the projecting directions and the front end edges 32F are spaced apart from the bottom surface 23 in the projecting directions thereof. The widths of the reinforcements 35 of this fifth embodiment in forward and backward directions (vertical direction in FIG. 10) crossing projecting directions of the reinforcements 35 are larger near a peripheral wall 21 and smaller at parts near a seal tower 18. The parts of the reinforcements 35 near the peripheral wall 21 are connected to the bottom surface 23, and front end edges 35F of the reinforcements 35 are substantially facing and spaced from the bottom surface 23 only at parts near the seal tower 18. Further, opening areas of water drains 36 are slightly larger than water passage holes 37.

Figure 11:
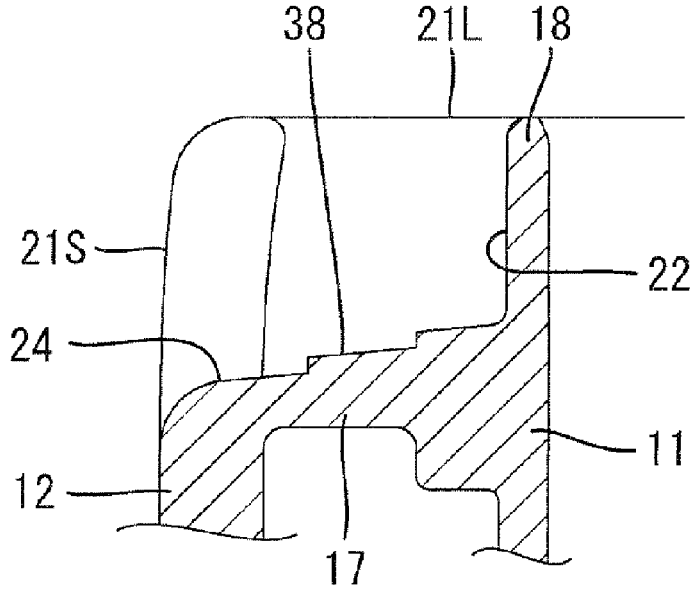
FIG. 11 is a partial enlarged section of a sixth embodiment.

A sixth embodiment of the invention is described with reference to FIG. 11. In the sixth embodiment, bottom surfaces 38 are shaped differently from the first embodiment. Since the other constructions are similar or substantially the same as in the first embodiment, similar or substantially the same constructions are identified by the same reference numerals and the structures, functions and effects thereof are not described.

The bottom surface 23 of the first embodiment is a substantially flat surface substantially perpendicular to the inserting direction of the terminal fittings 14 (penetration direction of the cavities 13), whereas the bottom surface 38 of this sixth embodiment is stepped to be successively lowered from a side of a seal tower 18 toward a peripheral wall 21 (toward water drains 24) with the bottom surface 38 (rear surface of a connector housing 10) faced up.

Figure 12:
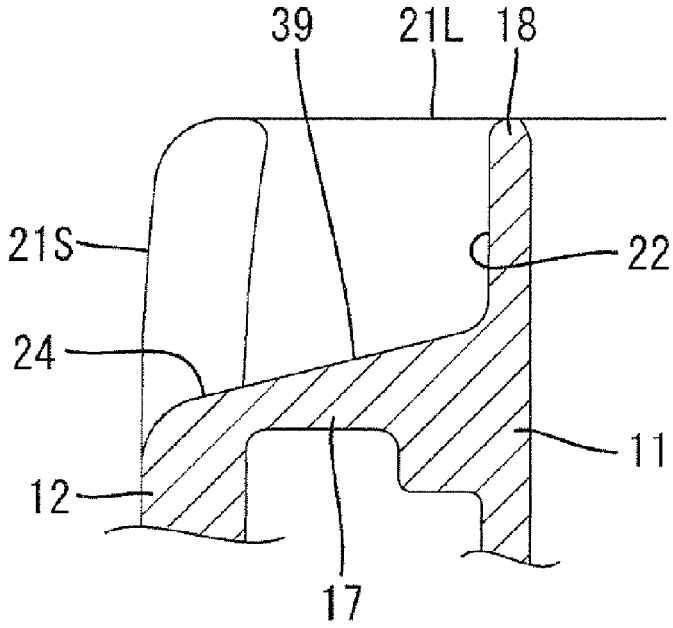
FIG. 12 is a partial enlarged section of a seventh embodiment.

A seventh embodiment of the invention is described with reference to FIG. 12. In the seventh embodiment, a bottom surface 39 is shaped differently from the first embodiment. Since the other constructions are similar or substantially the same as in the first embodiment, the similar or substantially same constructions are identified by the same reference numerals and the structures, functions and effects thereof are not described.

The bottom surface 23 of the first embodiment is substantially flat and perpendicular to the inserting direction of the terminal fittings 14 (penetration direction of the cavities 13), whereas the bottom surface 39 of this seventh embodiment is inclined at a substantially at a constant gradient to be gradually lower from a side of a seal tower 18 toward a peripheral wall 21 toward water drains 24 with the bottom surface 39 (rear surface of the housing 10) faced up.

The invention is not limited to the above described and illustrated embodiments. For example, the following embodiments also are included in the scope of the invention.

Although the present invention is applied to the lever-type connector in the above first to seventh embodiments, it is also applicable to connectors which do not use a lever or movable member or use a different force-multiplying mechanism.

Although four supporting portions are provided in the above first to third, sixth and seventh embodiments, the number of the supporting portions may be three or less or five or more.

Although two water drainage portions are provided in the first embodiment, the number of the water drainage portion(s) may be only one or three or more.

Although the water drainage portions are formed by cutting off the rear end edge of the peripheral wall portion in the first, sixth and seventh embodiments, they may be in the form of window holes in the first, sixth and seventh embodiment as in the fourth or fifth embodiment.

Although the water drainage portions are formed into window holes by cutting in the fourth and fifth embodiments, they may be formed by cutting off the rear end edge of the peripheral wall portion as in the first, sixth or seventh embodiment.

Although four reinforcing portions are provided in the fourth and fifth embodiments, the number of the reinforcing portions may be three or less or five or more.

Although the bottom surface is lowered from the seal tower portion toward the peripheral wall portion in the sixth and seventh embodiments, the height of the bottom surface may be varied in a circumferential direction in the first to seventh embodiments.

The bottom surface of the sixth and seventh embodiments lowered from the seal tower portion toward the peripheral wall portion is also applicable to the second to fifth embodiments.

What is claimed is:

1. A connector, comprising:

a housing;

a seal tower projecting from the housing;

a peripheral wall projecting from the housing and at least partly surrounding the seal tower;

at least one reinforcement projecting from an inner peripheral surface of the peripheral wall;

at least one terminal fitting to be inserted into the housing;

a seal through which at least one wire to be connected to the terminal fitting is to be passed, the seal being accommodated in the seal tower an outwardly open recess formed between an outer periphery of the seal tower and the inner peripheral surface of the peripheral wall; and at least one water drain formed in the peripheral wall and providing communication between the recess and an outer peripheral side of the peripheral wall.

2. The connector of claim 1, wherein the recess is substantially groove-shaped and annular, and wherein the bottom surface of the recess forms a rear surface of the housing and wherein the recess is open backward.

3. The connector of claim 1, wherein the bottom surface of the recess is substantially circumferentially continuous.

4. The connector of claim 3, wherein the bottom surface of the recess is circumferentially continuous and flush.

5. The connector of claim 1, wherein the water drain is formed by cutting off a rear end edge of the peripheral wall.

6. The connector of claim 1, wherein the at least one reinforcement is connected to the outer peripheral surface of the seal tower.

7. The connector of claim 1, wherein the front end edge of the at least one reinforcement faces and is spaced apart from the bottom surface.

8. The connector of claim 1, wherein at least one space between the bottom surface and the front end edge of the reinforcement in the recess serves as at least one water passage hole that allows the passage of water flowing along the bottom surface.

9. The connector of claim 8, wherein the water drain is formed into a window hole by cutting the peripheral wall in an area of projection of an opening of the water passage hole.

10. The connector of claim 1, wherein the bottom surface is stepped or inclined to be successively lowered from a side of the seal tower to the water drain with the bottom surface substantially faced up.

11. A connector, comprising:

a housing;

a seal tower projecting from the housing;

a peripheral wall projecting from the housing and at least partly surrounding the seal tower;

at least one terminal fitting to be inserted into the housing;

a seal through which at least one wire to be connected to the terminal fitting is to be passed, the seal being accommodated in the seal tower an outwardly open recess formed between an outer periphery of the seal tower and the inner peripheral surface of the peripheral wall; and at least one water drain formed in the peripheral wall and providing communication between the recess and an outer peripheral side of the peripheral wall wherein at least one support projects at an angle from the inner peripheral surface and is substantially continuous with the bottom surface are formed on the peripheral wall.

12. The connector of claim 11, wherein the support is substantially in the form of a plate with a substantially constant thickness or shaped such that the thickness thereof becomes larger toward the peripheral wall.

13. A connector, comprising:

a housing with a front mating end and a rear end opposite the front mating end, cavities extending through the housing from the front mating end to the rear end;

a seal tower projecting at the rear end of the housing a peripheral wall projecting at the rear end of the housing and at least partly surrounding the seal tower;

at least one reinforcement projecting from an inner peripheral surface of the peripheral wall toward the seal tower;

a rearwardly open recess formed between an outer periphery of the seal tower and the peripheral wall; and at least one water drain formed through the peripheral wall and providing communication between the recess and an outer peripheral side of the peripheral wall.

14. The connector of claim 13, wherein the water drain extends from a rear end edge of the peripheral wall to a rearwardly facing surface of the recess between the seal tower and the peripheral wall.

15. The connector of claim 13, wherein the reinforcement is connected to an outer peripheral surface of the seal tower and is spaced apart from the rearwardly facing surface of the recess.

16. The connector of claim 13, further comprising a seal accommodated in the seal tower.

* * * * *